US006968705B2

(12) United States Patent
Frati

(10) Patent No.: US 6,968,705 B2
(45) Date of Patent: Nov. 29, 2005

(54) METHOD AND PLANT FOR COOLING FLUIDS BY DIRECT CONTACT WITH LIQUEFIED GASES

(75) Inventor: Maurizio Frati, Milan (IT)

(73) Assignee: L'Air Liquide, Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 61 days.

(21) Appl. No.: 10/774,287

(22) Filed: Feb. 6, 2004

(65) Prior Publication Data

US 2005/0120725 A1 Jun. 9, 2005

(30) Foreign Application Priority Data

Dec. 3, 2003 (IT) ..... MI2003A2367

(51) Int. Cl.[7] ..... F25D 17/02
(52) U.S. Cl. ..... 62/64; 62/121; 62/50.2
(58) Field of Search ..... 62/64, 50.2, 98, 62/121, 373

(56) References Cited

U.S. PATENT DOCUMENTS 3,878,683 A * 4/1975 Imai ..... 60/647
4,141,224 A * 2/1979 Alger et al. ..... 62/50.1
4,237,695 A * 12/1980 Oberpriller et al. ..... 62/63
4,329,850 A * 5/1982 Drummond ..... 62/63
4,330,307 A * 5/1982 Coury ..... 62/618
4,348,867 A * 9/1982 Musschoot ..... 62/64
4,438,633 A * 3/1984 Hiser ..... 62/116
4,667,418 A * 5/1987 White ..... 34/504
5,106,400 A * 4/1992 Tick ..... 65/388
5,478,584 A * 12/1995 Donohue et al. ..... 426/644
5,802,858 A * 9/1998 Cheng et al. ..... 62/121
6,837,613 B2 * 1/2005 Terentiev ..... 366/273

FOREIGN PATENT DOCUMENTS

JP 356055798 A * 5/1981
JP 356080600 A * 7/1981
JP 401167565 A * 7/1989

* cited by examiner

*Primary Examiner*—William Doerrler
*Assistant Examiner*—Mohammad M. Ali
(74) *Attorney, Agent, or Firm*—Linda K. Russell; Elwood Haynes

(57) ABSTRACT

A method and apparatus for cooling a fluid in the liquid state, possibly also containing solid elements, comprising feeding said fluid into a containing member for said fluid and also feeding into said member a cooling fluid in the liquid state, such as a liquefied gas; said fluids are brought into direct contact within said containing member so that by absorbing heat, the cooling fluid passes into the gaseous state and cools the fluid to be cooled, these fluids then being extracted directly from said member by separate conduits.

27 Claims, 2 Drawing Sheets

METHOD AND PLANT FOR COOLING FLUIDS BY DIRECT CONTACT WITH LIQUEFIED GASES

This application claims the benefit of priority under 35 U.S.C. § 119 (a) and (b) 1 to Italian Application No. MI2003A002367, filed Dec. 3, 2003, the entire contents of which are incorporated herein by reference.

The present invention relates to a method and plant for cooling a fluid in accordance with the introduction to the corresponding independent claims.

BACKGROUND OF THE INVENTION

1. Field of the Invention

The invention provides a method and plant for cooling fluids in the liquid state, possibly also containing solid elements, by means of a cooling fluid consisting of a liquefied gas such as N2, CO2, Ar or a mixture thereof, the cooling fluid passing into the gaseous or vapour state following the heat transfer.

2. Related Art

As is widely known, to cool a liquid, apparatus or plants are usually used having surfaces of separation between the cooling fluid and the fluid to be cooled. However, this solution necessarily implies a low overall heat transfer coefficient and a mechanical action on the fluids due to the friction between these and the separation surfaces. This mechanical action limits the use of this type of apparatus if this phenomenon can degrade the organoleptic characteristics of the fluid to be cooled, such as in the case of pressed grape pulp.

A method for cooling fluids using liquefied gases is already known from a previous patent of the same applicant. That patent (IT1313938) describes a method for cooling a liquid in a controlled manner using liquefied gases as coolants, said liquid possibly also containing solid bodies. The method consists of feeding said liquid to be cooled into a containing member, also feeding into said member a suitable quantity of liquefied gas such that this latter comes into direct contact with said liquid, this contact leading to the transformation of the liquefied gas into a gaseous phase and to the cooling of the liquid, said gas or vapour and said cooled liquid then being extracted from the containing member.

In this prior patent a conduit is provided to transfer the cooled fluid and the gas or vapour, generated during heat transfer by the apparatus in which the heat transfer takes place, to the apparatus in which the two fluids are separated, this conduit being traversed by the fluids at high velocity so that both the cooled liquid, or two-phase solid-liquid mixture, and the cooling fluid in the gas or vapour state are transferred simultaneously.

OBJECTS OF THE INVENTION

If the characteristics of the liquid to be cooled are such as to enable it, any contained solid parts may undergo damage within this conduit because of their high velocity, a non-limiting example being damage to the grapes in the case of pressed grape pulp.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

An object of the present invention is to provide a method and plant for cooling a liquid, possibly also containing solid elements, which represent an improvement over similar known methods and plants.

Another object is to provide a plant which uses compact apparatus and simplified operative modalities compared with similar known plants.

These and further objects which will be apparent to the expert of the art are attained by a method and plant in accordance with the accompanying claims.

The present invention will be more apparent from the accompanying drawing, which is provided by way of non-limiting example, and in which:

DESCRIPTION OF PREFERRED EMBODIMENTS

Conduit 3 is the Subject Fluid Conduit.
Conduit 6 is the Cooling Fluid Conduit.
Conduit 9 is the Vapor Conduit.
Conduit 14 is the Cooled Subject Fluid Discharge Conduit.
Conduit 18 is the Cooling Gas Discharge Conduit.
Conduit 20 is the Auxiliary gas Conduit.
Conduits 22, 26 are the Recycle Conduits.
Conduit 24 is the Feed Conduit.

Figure 1:
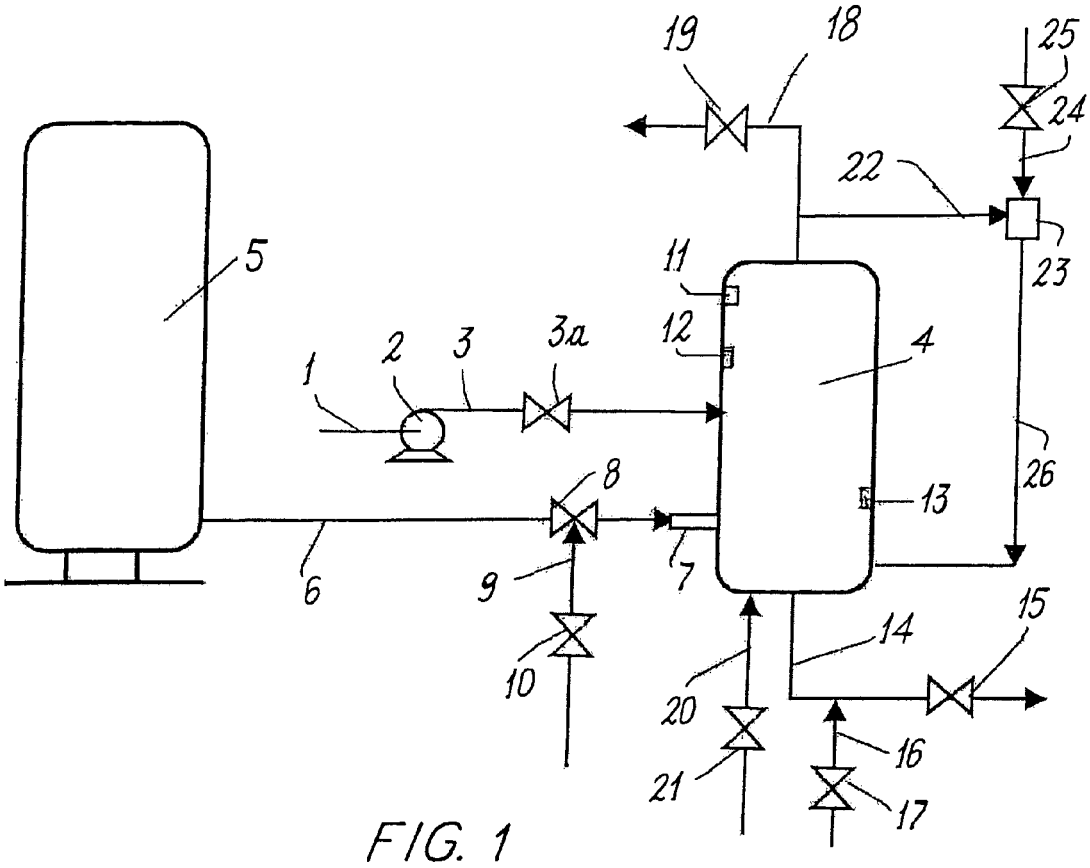
Figure 2:
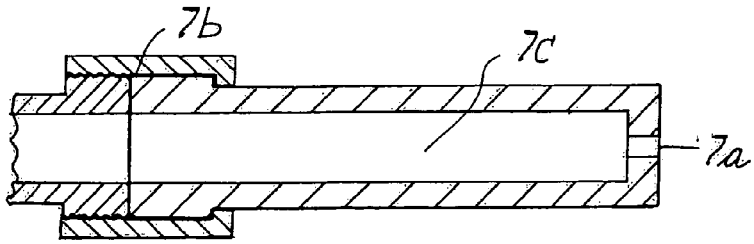
Figure 3:
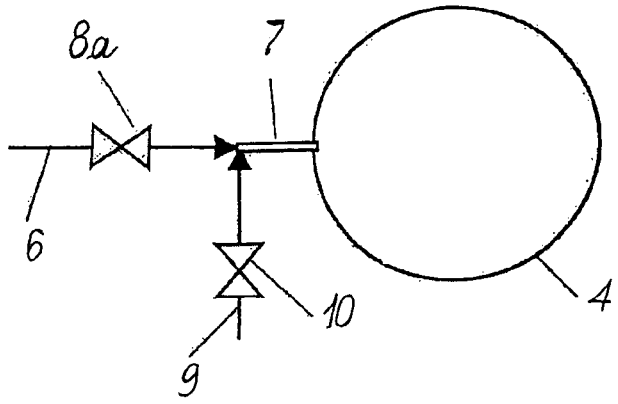
Figure 4:
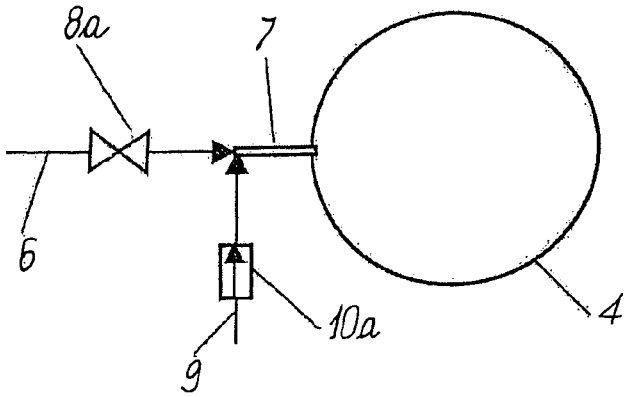
Figure 5:
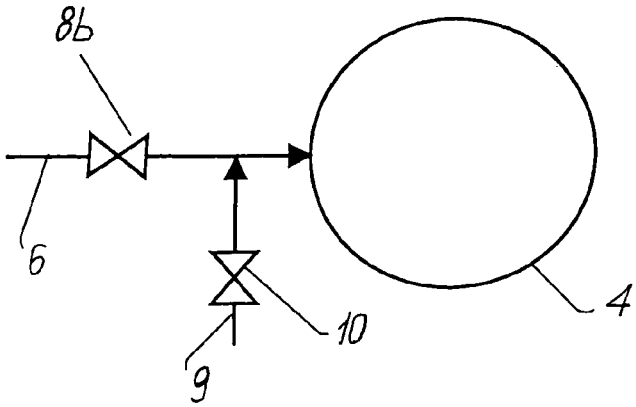

FIG. 1 is a schematic view of a plant according to the invention;

FIG. 2 shows a liquefied gas injector of the plant of FIG. 1;

FIGS. 3, 4 and 5 show three variants of the feed line for the liquefied cooling gas and the gas or vapour used in the plant of FIG. 1.

With reference to the said figures, a line 1 is shown comprising a pump 2 drawing a liquid to be cooled (contained in its own tank or present in a transfer line, not shown). From the pump there extends a pipe 3 provided with a valve 3*a* through which the liquid to be cooled is fed to a containing and heat transfer member (or cooler) 4 where it comes into direct contact with a liquefied gas taken from its own storage tank 5 via one or more lines 6 (of which only one is shown in the figures) provided with a three-way valve 8 and injector 7 which feeds the liquefied gas into the cooler 4. The injector 7, shown in FIG. 2, is sized to enable definite quantities of liquefied gas to pass through a sized hole 7*a* after the liquefied gas, originating from the pipe 6, has passed through the portion 7*c*.

Gas or vapour is fed in the aforedescribed manner to prevent the injector 7 filling with cooling liquid along the portion 7*c* when liquefied gas feed via the injector is not required, with the risk that on again connecting the injector 7 associated with the line 6, contact takes place between the liquefied gas and the liquid to be cooled, with possible freezing of this latter because of the low temperature attained, and consequent obstruction of the injector 7, so preventing its correct operation.

If the pressure in the tank 5 is insufficient for injecting the liquefied gas into the cooler 4, a pump with suitable characteristics for supplying the necessary pressure is connected into the line 6, said pump not being shown in the figures.

By way of example, the cooling fluid is a liquefied gas such as N2, CO2 or Ar.

A gas or vapour pipe 9 provided with a valve 10 is connected to the valve 8, of known three-way type, the gas or vapour being injected, by the injector 7, into the cooler 4 instead of the liquefied gas when the valve 8 shuts off liquefied gas passage along the pipe 6.

Gas or vapour is fed in the aforedecribed manner to prevent the injector 7 filling with cooling liquid along the portion 7*c* when liquefied gas feed via the injector is not required, with the risk that on again connecting the injector 7 associated with the line 6, contact takes place between the liquefied gas and the liquid to be cooled, with possible freezing of this latter because of the low temperature attained, and consequent obstruction of the injector 7, so preventing its correct operation.

FIGS. 3 and 4 show two alternative solutions for injecting gas or vapour into the injector 7 when this latter is not traversed by the liquefied gas.

Specifically, in the solution shown in FIG. 3 the three-way valve is replaced by two one-way valves, one connected into the pipe 6 and one into the pipe 9; with this solution, when liquefied gas is to be injected the valve 8*a* is opened and the valve 10 is closed and, vice versa, when gas is to be injected the valve 10 is closed and the valve 8*a* is opened.

The solution shown in FIG. 4 is usable when the pressure of the gas or vapour present in the pipe 9 is less than that of the liquefied gas present in the pipe 6 and greater than that present in the cooler 4, and consists of replacing the valve 10, shown in FIGS. 1 and 3, with a unidirectional non-return valve 10*a* which allows gas or vapour to pass when the valve 8 is closed.

From the aforestated it follows that the injector 7 is always traversed by a liquefied gas or by a gas or vapour, so preventing the presence in the portion 7*c* of liquid to be cooled.

FIG. 5 shows a solution which does not use the injector 7 with the sized hole 7*a*, but uses only a control valve 8*b* to dispense the liquefied gas.

In the cooler 4 the direct contact between liquefied gas and the liquid to be cooled takes place at higher than atmospheric pressure. Known components are installed in the cooler to measure the process parameters such as one or more temperature indicators 13, level indicators 12 and pressure indicators 11.

A discharge pipe 18 with relative valve 19 is installed in the top of the cooler 4 to evacuate the gas or vapour generated by the liquefied gas which is developed within the cooler 4 as a result of heat transfer. By suitably regulating the opening of the valve 19, the pressure within the container member 4 can be regulated, as will be described, this pressure being used to push the cooled liquid out of the container member 4 via the line 14.

A part of the gas or vapour developed within the cooler 4 can be withdrawn from the pipe 18 by a pipe 22, this gas or vapour part being fed, using a powering fluid originating from the line 24 (connected to a suitable tank or to a distributor line thereof) provided with a valve 25, and aided by a known injector 23, into the bottom of the cooler 4 to adequately mix the liquid to be cooled and the liquefied gas present therein. For example, the injector 23 is an expansion-compression conduit known as a Venturi tube, but can be any other machine which draws in and compresses the vapour drawn from the cooler 4 using electromechanical energy without the aid of a powering fluid.

The said control unit (not shown) receives the values of the measured parameters such as temperatures from the indicator 13, the level from the indicator 12, and the pressure from the indicator 11, and processes the determined values in accordance with known algorithms with which the system is provided. The result of processing the said algorithms is the definition of the state (such as valve positions, i.e. open/closed/partially open, etc.) of the said components during operation, this state being achieved by the system with the aid of known controlled electropneumatic components connected to the movable parts of the plant (for example valves).

This expedient means that because of this mixing action, when the flow of cooled liquid is to continue, the friction which the pressure in the cooler 4 has to overcome is of dynamic instead of static type, it being well known that dynamic friction is less than static friction so that the pressure required to reactivate the flow is less in this case than without mixing the liquid, the initial flow reactivation rate consequently being less than without fluidification, so more slowly modifying the operating conditions and hence limiting the system oscillations about hydrodynamic equilibrium.

In the bottom of the cooler 4 there is also installed a pipe 20 with relative valve 21 for possible addition of gas or vapour for the purpose of adequately mixing together the liquid to be cooled and the cooling gas, within the cooler.

To control the cooling process, the invention comprises a control unit (not shown, comprising for example an electronic processor and/or a programmable unit or PC) and other known electromechanical components, the purpose of which is to position the plant components (such as the valves 8, 10, 15, 17, 19, 21, 25 and the pump 2) as required for proper operation of the plant and in accordance with the logic described hereinafter.

The said control unit (not shown) receives the values of the measured parameters such as temperatures from the indicator 13, the level from the indicator 12, and the pressure from the indicator 11, and processes the determined values in accordance with known algorithms with which the system is provided. The result of processing the said algorithms is the definition of the state (such as valve; positions, i.e. open/closed/partially open etc.) of the said components during operation, this state being achieved by the system with the aid of known controlled electropneumatic components connected to the movable parts of the plant (for example valves).

A possible method of operating the invention will now be described by way of non-limiting illustration.

The liquid to be cooled is forced through the plant 3 and into the cooler 4 where its level is determined by the indicator 12 and its temperature by the probe 13. The level indicator 12 is linked by algorithmic correlation to a valve 19 connected into the pipe 18, this algorithmic correlation associating a determined degree of opening of the valve 19 with the level of the fluid present in the cooler 4, determined by the indicator 12. Specifically, various correlation algorithms can be used but all have the following characteristics:

- lesser opening of the valve 19 corresponds to greater level,
- total closure of the valve 19 corresponds to a level chosen as the maximum allowable for operation.

The temperature indicator 13 continuously determines the temperature of the mixture of fluids, i.e. the liquid to be cooled, the liquefied gas and liquefied gas vapour, present in the cooler 4 and if this is greater than the required set value, the control unit feeds liquefied gas into the cooler 4 via one or more lines 6 connected to one or more injectors 7.

Those injectors 7 which at a given time are not traversed by liquefied gas are traversed instead by gas or vapour via the pipes 9 connected to the injectors by correctly positioning the three-way valve and opening the valve 10; alternatively, if the three-way valve 3 is not present but instead one of the expedients indicated in FIGS. 3 and 4 is provided, these connections are made by closing the valve 8*a* and opening the valve 10 if the expedient adopted is that indicated in FIG. 3, or by closing only the valve 8*a* if the expedient adopted is that of FIG. 4.

At the commencement of the cooling process, the liquid to be cooled, forced into the cooler 4 by the pump 2, begins to fill the cooler, and when its level reaches a minimum threshold, definable at any particular time by the control unit, this latter opens the valve 15 and possibly the valve 17 connected into the pipe 16, to enable the cooled liquid contained in 4, if the internal pressure allows it, to emerge for feeding to the required destination.

The valve 17 is opened mainly when the cooled liquid has a high viscosity, hence presenting a considerable resistance to movement and therefore requiring a high pressure within the cooler 4.

As the feed of liquid to be cooled continues, its level within the cooler 4 continues to increase. By virtue of the correlation between the level and the degree of opening of the valve 19 and consequently of the pressure drop that this generates in the vapour leaving the pipe 18, at a certain point a pressure is attained in the cooler which is sufficient to overcome the pressure drop through the transfer line 14. On attaining this pressure, the cooled liquid begins to leave the cooler through the pipe 14.

For a better understanding of the aforestated, it should be noted that the said sufficient pressure is attained because if cooled liquid is not emerging or emerging at a lower rate than the entry rate, the fluid level within the cooler increases, then by virtue of the algorithmic correlation between the measured level and the opening of the valve 19 connected into the discharge pipe 18 for the gas or vapour generated by heat transfer between the liquefied gas and the liquid to be cooled, the valve 19 tends to close, to offer a resistance to gas or vapour exit and hence generate within the cooler 4 a pressure necessary and sufficient to eject the cooled liquid.

The pressure stabilizes at a value such as to enable an exit flow rate of cooled liquid to be achieved equal to the entry flow rate, this signifying a constant level and hence, if in the meantime there have been no variations in the flow of gas or vapour generated by the refrigerant fluid to be disposed of, a constant degree of opening of the valve 19, so attaining a hydrodynamic equilibrium situation within the cooler.

The value of the parameters involved in the hydrodynamic equilibrium position, such as internal pressure and fluid level and/or opening of the valve 19, can vary with time depending on the hydrodynamic characteristics of the fluids concerned, the liquefied gas and the liquid to be cooled, their flow rates and the pressure drops which the cooled liquid has to overcome to reach its next destination, downstream of the pipe 14.

The invention, structured in this manner, operates continuously by injecting that quantity of liquefied gas necessary and sufficient for the required cooling of the liquid transiting through the cooler 4.

If the liquid to be cooled has a viscosity and/or density such that its mixing by the gas or vapour developed by the liquefied gas and passing through the fluid mass contained in the cooler 4 is insufficient for uniform cooling, the required mixing can be achieved by feeding into it a quantity of gas or vapour sufficient for the purpose via the pipe 20 and valve 21.

Another way of achieving sufficient mixing, while limiting the gas or vapour quantity to be added, is to use the pipes 22, 24, 26, the injector 23 and the valve 25 in the following manner.

By opening the valve 25 to a defined extent, a determined quantity of gas or liquid enters the injector 23 via the line 24, to act as a powering fluid which, by creating a vacuum in the pipe 22, draws the gas or vapour from the line 18 and mixes it with the powering gas or vapour which, via the pipe 26 is fed to the bottom of the cooler 4 to hence achieve an adequate degree of mixing.

On termination of the cooling process, the cooler can be emptied of its contents by simply not feeding the liquid to be closed, closing the valve 3*a* and the valve 19 and feeding gas, vapour or liquefied gas into the cooler until this produces a pressure sufficient to expel all the cooled liquid contained in the cooler.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for the controlled continuous cooling of a subject fluid by using a cooling fluid comprising:

a) introducing said subject fluid into a containing member, wherein said subject fluid is in the liquid state, said containing member further comprising an upper end and a lower end, b) providing a cooling fluid to a tank, wherein said tank is fluidly connected to said containing member by at least one conduit, c) introducing said cooling fluid into said containing member, d) directly contacting said cooling fluid with said subject fluid in said containing member, e) cooling said subject fluid, wherein said cooling fluid enters the vapor phase, f) removing said cooling fluid in the vapor state and said subject fluid from said containing member.

2. The method according to claim 1, wherein said subject fluid is a consumable goods.

3. The method of claim 1, wherein said subject fluid is a food product.

4. The method of claim 1, wherein said subject fluid is single-phase.

5. The method of claim 1, wherein said subject fluid is multi-phase.

6. The method of claim 5, wherein said subject fluid contains solid bodies.

7. The method according to claim 1, wherein the contact between the cooling fluid and the subject fluid takes place at a pressure greater than atmospheric.

8. The method according to claim 7, wherein the cooling fluid fed to the containing member is pressurized.

9. The method according to claim 7, wherein the pressure in the containing member is used to evacuate the subject fluid from said containing member.

10. The method according to claim 7, wherein the pressure in the containing member is regulated by the pressure drop through a valve positioned in a discharge conduit for said cooling fluid in vapor state.

11. The method according to claim 7, wherein the pressure in the containing member is regulated on the basis of the level of the subject fluid in said containing member.

12. The method according to claim 1, wherein the cooling fluid is selected from the group consisting of N2, CO2 and Ar.

13. The method according to claim 1, wherein said subject fluid is removed at the lower end of said containing member, and said cooling fluid in vapor state are removed from the upper end of said containing member.

14. The method according to claim 13, wherein said vapor is inserted into the containing member to facilitate mixing between the subject fluid and the cooling fluid.

15. The method according to claim 14, wherein the inserted vapor is chemically identical to the cooling fluid.

16. The method according to claim 14, wherein the inserted vapor is chemically different from the cooling fluid.

17. The method according to claim 1, wherein one or more of the temperature, the pressure and the level of the fluid in the containing member is continuously controlled.

18. The method according to claim 14, wherein the vapor is inserted into the containing member in accordance with the physical characteristics of the subject fluid which is present in said containing member.

19. An apparatus for the controlled continuous cooling of a subject fluid by using a cooling fluid comprising:

a) a tank of cooling fluid, said cooling fluid comprising a liquefied gas, b) a containing member, c) said tank being connected to said containing member by a cooling fluid conduit, d) said containing member comprising a subject fluid conduit, e) said containing member comprising at least one internal chamber to which said cooling fluid conduit and said subject fluid conduit are connected and within which said subject fluid is placed into direct contact with said cooling fluid, f) said containing member comprising cooling gas discharge conduit and cooled subject fluid discharge conduit through which cooling fluid in vapor phase and cooled subject fluid are separately extracted after their mutual direct contact.

20. The apparatus according to claim 19, wherein cooling fluid conduit is connected to the containing member via an injector with an orifice sized for the entry of said cooling fluid into said containing member.

21. The apparatus according to claim 19, wherein said cooling fluid conduit is connected to the containing member by a pipe provided with a flow control valve.

22. The apparatus according to claim 20, wherein a vapor conduit is connected to the liquefied gas conduit, said vapor conduit feeding said vapor to said injector when the flow of liquefied gas to the containing member through said cooling fluid conduit ceases.

23. The apparatus according to claim 20, wherein said cooling gas discharge conduit is connected to a circuit unit, said circuit unit comprising recycle conduits and said injector, wherein said circuit unit withdraws part of said vapor from said cooling gas discharge conduit and injects it into said containing member in order to facilitate mixing of said cooling fluid with said subject liquid.

24. The apparatus according to claim 23, wherein said circuit unit is connected to a feed conduit for powering fluid.

25. The apparatus according to claim 23, wherein an auxiliary gas conduit is connected to a lower part of said containing member in order to feed gas or vapor into said containing member to facilitate mixing of the cooling fluid with the subject fluid.

26. The apparatus according to claim 19, wherein said cooling gas discharge conduit comprises a valve member enabling the pressure in the interior of said member to be regulated.

27. The apparatus according to claim 19, further comprising plant control means connected to measurement means for measuring one or more of the temperature, the pressure, or the level of the fluids within said containing member.

* * * * *